United States Patent [19]

Taylor et al.

[11] Patent Number: 4,910,943

[45] Date of Patent: Mar. 27, 1990

[54] FILM DRIVE UNIT FOR A PACKAGING MACHINE

[76] Inventors: Alfred A. Taylor; John P. North, both of Suite 18, Jacobs Street, Banktown, New South Wales 2200, Australia

[21] Appl. No.: 144,816

[22] Filed: Jan. 13, 1988

[30] Foreign Application Priority Data

Jan. 14, 1987 [AU] Australia ..... PH9866

[51] Int. Cl.[4] ..... B65B 9/06; B65H 20/12

[52] U.S. Cl. ..... 53/551; 226/95

[58] Field of Search ..... 53/550, 551, 552, 553, 53/555, 557; 226/95

[56] References Cited

U.S. PATENT DOCUMENTS

| | | | |
|---|---|---|---|
| 2,113,636 | 4/1938 | Vogt | 53/551 X |
| 4,043,098 | 8/1977 | Putnam, Jr. et al. | 53/551 |
| 4,067,761 | 1/1978 | Shirley | 53/551 X |
| 4,118,913 | 10/1978 | Putnam, Jr. et al. | 53/551 |
| 4,136,505 | 1/1979 | Putnam, Jr. et al. | 53/551 |
| 4,207,998 | 6/1980 | Schmid | 226/95 |
| 4,288,965 | 9/1981 | James | 53/551 X |
| 4,532,753 | 8/1985 | Kovacs | 53/552 X |
| 4,578,931 | 4/1986 | Roovers | 53/551 |

*Primary Examiner*—Robert L. Spruill
*Assistant Examiner*—Beth Bianca
*Attorney, Agent, or Firm*—Ladas & Parry

[57] ABSTRACT

A film drive unit 10 for a packaging machine to move sheet material 16 through the unit 10, the film drive unit 10 includes at least one rotatably driven roller 18 which is hollow and to which a vacuum is delivered to the interior thereof, with the roller 18 having an outer cylindrical member 30 with radially extending passages 39 to which the vacuum is applied to draw the sheet material 16 into contact with the cylindrical outer surface of the roller 18.

6 Claims, 5 Drawing Sheets

FILM DRIVE UNIT FOR A PACKAGING MACHINE

The present invention relates to packaging machines and more particularly to a film drive unit of a packaging machine.

In the packaging of products which comprises a plurality of discrete units, it is common for a tubular bag material to be formed from sheet material, the tubular bag material is delivered to a filling head whereat the product is delivered to the interior of the tube material. The tube material is subsequently sealed at spaced intervals and discrete bag severed from the tubular material. The sheet material generally comprises a plastic film which is sealed by heat or other means to form the tubular material. The plastic film is joined along its longitudinal edges to form the tubular material. Generally the film is drawn through the packaing machine by means of vacuum belts or alternatively the sealing head frictionally engage the tube material in order to advance the tubular material through the packaging machine.

Packaging apparatus which employ belts to pull the bag material throught the apparatus are described in U.S. Pat. Nos. 4,501,109; 3,844,090; 4,128,985; 4,423,585; 4,288,965 and 4,663,917. In these U.S. patents, the belts frictionally engage the bag material, which frictional contact is sometimes enhanced by applying a vacuum to the rear side of the belt.

U.S. Pat. Nos. 4,524,567 and 3,850,780 describe rotary sealing jaws, which frictionally engage the bag material to draw the bag materail through the packaging apparatus.

In many machines rollers are employed to advance the packaging material through the apparatus. For example, in U.S. Pat. No. 3,916,598, rollers pull the bag material over a former.

In the above discussed U.S. patents, where rollers are employed, so means of enhancing frictional contact with the bag material is provided while still further, the rollers are not used to longtudinally seal the bag material.

The above discussed methods of moving the tubular bag material through the packaging machine are generally complex and therefore costly to manufacture. Additionally their complexity adds to the maintenance required.

It is the object of the present invention to overcome or substantially ameliorate the above disadvantages.

There is disclosed herein a film drive unit to move sheet material, said drive unit including at least one driven roller which frictionally engages the material to cause movement thereof upon operation of the roller, said roller including a hollow cylindrical driven member with a cylindrical outer surface which engages the material, and a cylindrical inner surface, a generally stationery plenum member located within said cylindrical member and about which said cylindrical member rotates, said plenum member including a base portion and a movable vacuum transfer portion supported by the base portion and in contact with said inner cylindrical surface, duct means to deliver a vacuum to said vacuum transfer portion, a vacuum cavity formed in said transfer portion and extending angularly along said inner cylindrical surface so as to apply a vacuum thereto at a position adjacent where the material contacts said outer cylindrical surface, and a plurality of passages in said cylindrical member and extending between the inner and outer cylindrical surfaces thereof, said passages being alignable with said vacuum cavity so that upon communication therewith a vacuum is transferred to said outer cylindrical surface to draw said material into contact with said outer cylindrical surface.

A preferred form of the present invention will now be described by way of example with reference to the accompanying drawings, wherein.

Figure 1:
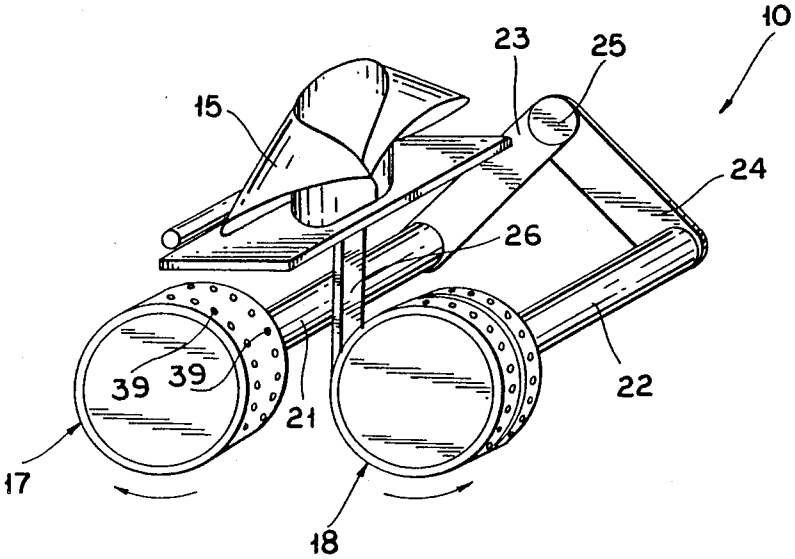
FIG. 1 is a schematic perspective view of a film drive unit for a packaging machine.

In the accompanying drawings there is schematically depicted a film drive unit 10 of a packaging machine 11. The packaging machine 11 has a shaft 12 which receives a roll 13 of plastic film which is in strip form. The film 14 is delivered in a conventional manner to a former 15 which wraps the film 14 about a longitudinal axis so as to form tubular bag material 16. The tubular bag material is moved by means of a pair of rollers 17 and 18.

Located above the former 15 is a deliver hopper 19 having a lower end through which the material to be packaged is delivered into the tubular bag material 16. The tubular bag material 16, after passing the rollers 17 and 18 enters a severing and sealing assembly 20 which forms discrete bags.

The rollers 17 and 18 form part of the film drive unit, more fully depicted in FIG. 1. The rollers 17 and 18 are mounted on supports 21 and 22 which are in turn mounted on linkages 23 and 24 pivotally mounted at their joint 25 so that the rollers 17 and 18 may be adjusted in their spacing from each other. The rollers 17 and 18 are mounted on their supports 21 and 22 so as to be rotatable about general parallel axes.

Extending downwardly from within the former 15 is a back seal bar 26 which co-operates with the roller 18 to join the longitudinal edge portions of the film strip 14 to form the tubular material 16. In this particular embodiment, the longitudinal edge portions are heat sealed.

Figure 6:
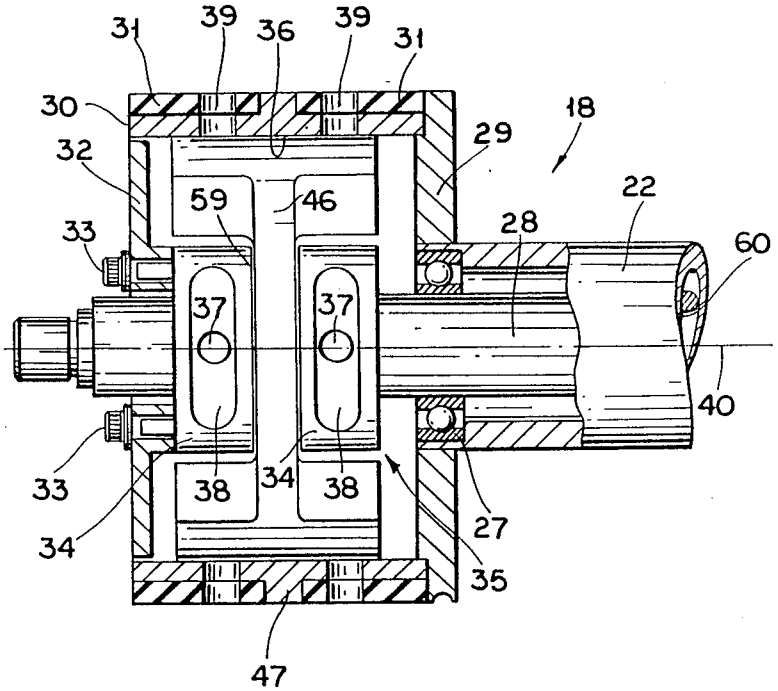
FIG. 6 is a schematic sectioned side elevation of the roller of FIG. 5 sectioned along the line A—A.
Figure 5:
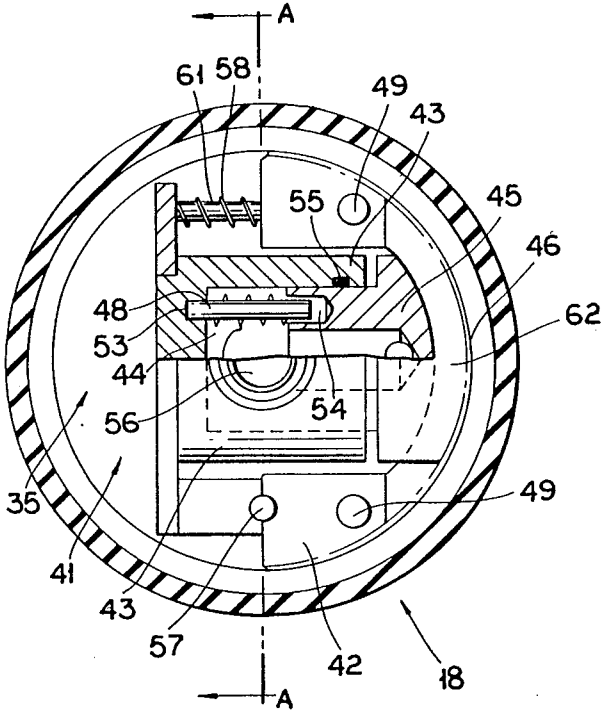
FIG. 5 is a schematic part sectioned end elevation of a roller employed in the drive unit of FIG. 1.
Figure 7:
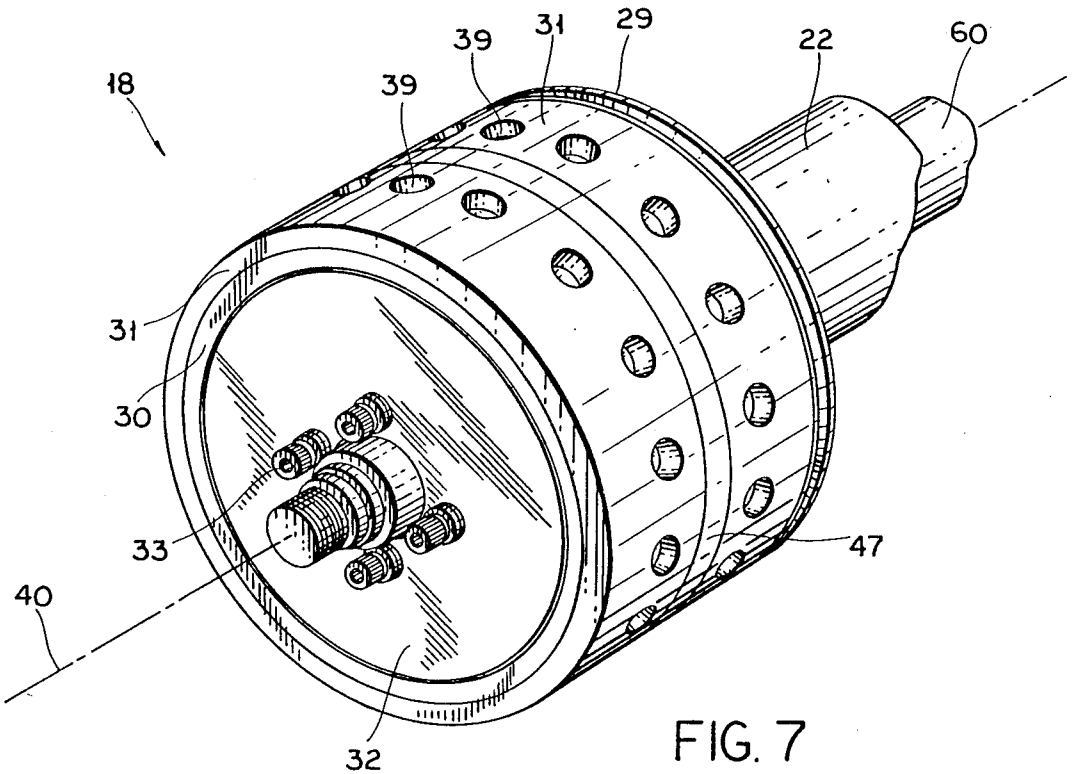
FIG. 7 is a schematic perspective view of the roller of FIGS. 5 and 6.
Figure 8:
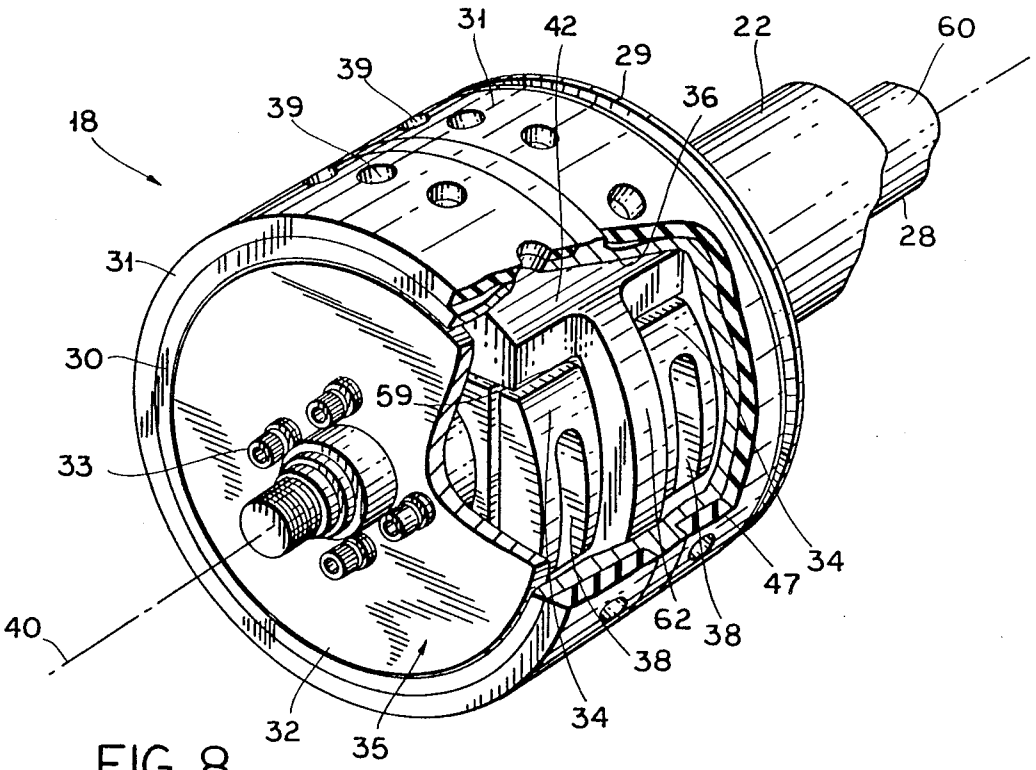
FIG. 8 is a schematic perspective view of the roller illustrated in FIG. 7 with a cut away section.

In FIGS. 5 and 6 the roller 18 is more fully depicted. As described previously, the roller 18 is rotatably mounted on a support 22 which is a driven tubular member supported at its extremity by means of a bearing 27 mounted on a spigot 28. Extending radially from the support 22 is a flange 29 which supports a cylindrical member 30 which receives a high friction material 31 (or surface finish for example silicon rubber) to aid in gripping the tubular plastics material 16. An end plate 32 is attached to the spigot 28 by means of threaded fasteners 33 engaging a plenum member 35 mounted on the spigot 28. The plenum member 35 is provided with plenum wear pads 34 which engage the inner surface 36 of the cylindrical member 30. The spigot 28 is tubular, so as to provide passage 60, and is connected to plenum chamber 56. Extending from plenum chamber 56 are passages 37 which communicate with plenum cavities 38 aligned with rows of aperture 39 extending through the cylindrical member 30 and the friction material 31 mounted thereon. The cavities 38 extend angularly about the axis 40 of the roller 18 so as to communicate with the apertures 39 over a predetermined angular displacement about the axis 40.

The plenum member 35 provides a plenum base portion in the form of a flange 43 having an internal cylindrical surface 44 enclosing the plenum chamber 56 which slidably receives a vacuum transfer member in the form of a piston 45 biased outwardly by means of a pair of springs 48 wound around guide pins 53. The guide pins 53 are slidably received within cavities 54 formed in the piston 45. A sealing ring 55 sealingly connects the piston 45 and the internal cylindrical surface 44 of the flange 43 so that a vacuum delivered to the plenum chamber 56 is contained and delivered to the outer surface of the roller 18 via passages 37 extending to the plenum cavities 38. The outer peripheral surfaces of the piston 45 are provided with the plenum wear pads 34.

A heater assembly 41 is also mounted on the spigot 28. The heater assembly 41 includes a base 42 which is semi-circular in configuration and has an angular peripheral surface 46 which engages the inner surface 36 of the cylindrical member 30 so as to transfer heat to the annular projection 47 of the cylindrical member 30. The base 42 is pivotally mounted by means of a pin 57, and is biased outward into contact with the surface 36 by means of a spring 58 wound around a guide pin 61 slidably received within the base 42. The base 42 is also provided with a heater element 49 which receives an electric current.

In the present embodiment, only the roller 18 is provided with a heater assembly 41. This requires the piston 45 to have an arcuate slot 59 through which the angular portion 62 of the base 42 passes.

In operation of the heater assembly 41, the projection 47 engages the bag material to cause fusion thereof by heating the bag material.

The roller 17 is of a similar configuration to the roller 18 however no heater assembly 41 is provided. However the roller 17 is rotatably driven and is provided with apertures 39 selectively communicating with a plenum in a similar manner to the roller 18.

It should be appreciated that the plenum cavities 38 of the roller 18, and the similar plenum cavities within the roller 17, are located so as to be adjacent the tubular material 16 so as to draw the tubular material 16 into frictional contact with the outer surfaces of the rollers 17 and 18 by the application of a vacuum to the plenum chambers 56. The vacuum is delivered to the plenum chambers 56 by a vacuum being applied to the interior of the spigot 28. Since both the supports 21 and 22, of this embodiment, are rotatably driven, the tubular material 16 is drawn from the roll 13 of the former 15 to be delivered to the assembly 20.

Figure 2:
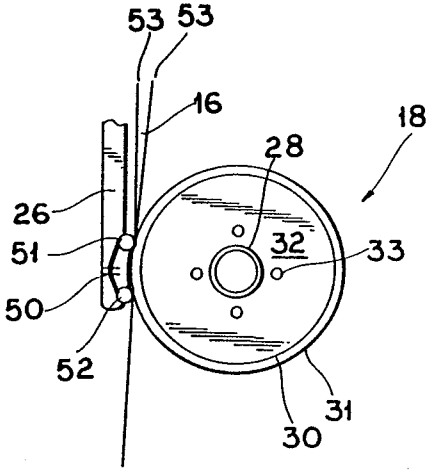
FIG. 2 is a schematic side elevation of a portion of the drive unit of FIG. 1.
Figure 4:
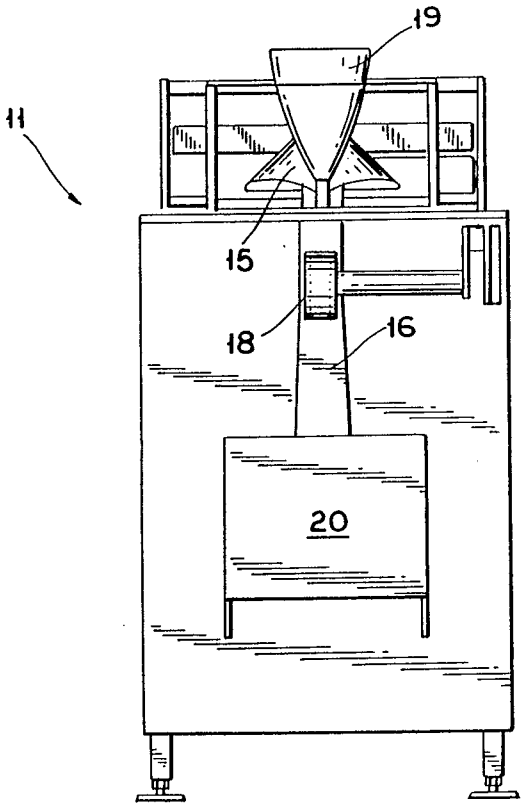
FIG. 4 is a schematic end elevation of the packaging machine of FIG. 3.
Figure 3:
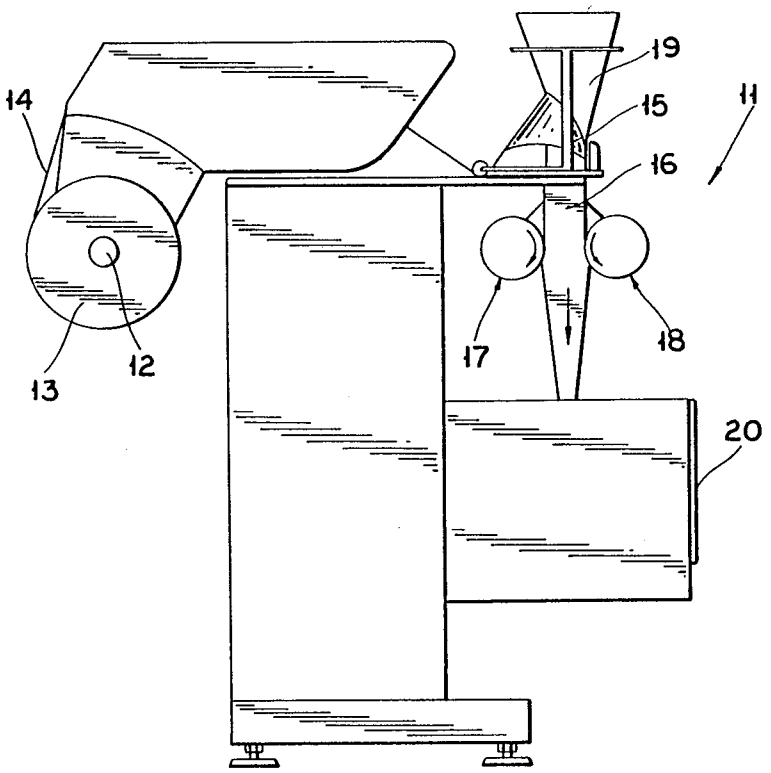
FIG. 3 is a schematic side elevation of the drive unit of FIG. 1 incorporated in a packaging machine.

In FIG. 2 the lower extremity of the back seal bar 26 is more fully shown. The back seal bar 26 is provided at its lower end with a carriage 50 supporting two rollers 51 and 52 which press the tubular bag material 16 into contact with the heated annular flange 47 of the roller 18 so as to seal the longitudinal edges 53, of the tubular bag material 16 together.

If so required, neither of the rollers 17 or 18 could be provided with a heater assembly 41. In such an instance longitudinal sealing of the bag material would be carried out at a location before the bag material reach the rollers 17 and 18. For example, such sealing may be by way of the delivery of hot air to the overlapping portions of the bag material to cause a longitudinal sealing thereof.

What we claim is:

1. A driven roller for a film drive unit to frictionally engage and move sheet material in a packaging machine upon operation of said driven roller, said driven roller comprising:

a hollow cylindrical drive member having a cylindrical outer surface to engage said material and a cylindrical inner surface, said cylindrical member having a plurality of apertures extending between said inner and outer surfaces; and a generally stationary plenum member within said cylindrical member and about which said cylindrical member rotates, said plenum member comprising a base portion and a movable vacuum transfer portion supported by said base portion and engaging said inner surface, said base portion and said vacuum transfer portion co-operating to provide a plenum chamber, a duct means in fluid communication with said plenum chamber to deliver a vacuum thereto to generate a negative pressure in said plenum chamber, and at least one vacuum cavity, formed in said vaccum transfer portion, extending angularly long said inner cylindrical surface so as to be radially aligned with said apertures as they pass said cavity, said vacuum cavity is in fluid communication with said plenum chamber so that a negative pressure can be formed at said apertures so as to draw said material into contact with said outer cylindrical surface.

2. The driven roller of claim 1 wherein said transfer portion includes a wear pad to contact said inner surface, said wear pads providing at least a portion of said vacuum cavity.

3. The driven roller according to claim 1 wherein said movable vacuum transfer portion comprises a cooperating piston and cylinder, said piston having at least one passage extending between said plenum chamber and said vacuum cavity.

4. The driven roller according to claim 3 further comprising a hollow drive shaft to rotate said driven roller, said drive shaft is connected to a radially extending flange which is connected to said cylindrical member, and a spigot, extending through said drive shaft, connected to said plenum member and through which said duct means passes.

5. The driven roller according to claim 4 wherein said cylindrical member includes an annular projection formed on the outer cylindrical surface of said cylindrical member, and wherein said driven roller includes a heater assembly in contact with the inner cylindrical surface of said cylindrical member to apply heat thereto, to heat said annular projection.

6. The driven roller according to claim 5 wherein said heater assembly includes a heater base mounted on said spigot and resiliently biased outward by a spring means to engage said inner cylindrical surface, said heater base having heater elements mounted therein.

* * * * *